US005238153A

United States Patent [19]

Castillo et al.

[11] Patent Number: 5,238,153

[45] Date of Patent: Aug. 24, 1993

[54] DISPENSER FOR DISPERSING STERILE SOLUTIONS

[75] Inventors: Bradley E. Castillo, Emeryville; Joseph E. Tungol, Elk Grove; Edgar M. Litzaw, San Anselmo, all of Calif.

[73] Assignee: Pilkington Visioncare Inc., Menlo Park, Calif.

[21] Appl. No.: 656,867

[22] Filed: Feb. 19, 1991

[51] Int. Cl.[5] ..... B65D 37/00

[52] U.S. Cl. ..... 222/189; 222/212; 222/422; 222/481.5; 222/484; 222/493; 222/494; 222/495; 239/327; 239/590

[58] Field of Search ..... 222/189, 212, 420, 422, 222/481.5, 484, 492, 493, 494, 481, 495, 496, 213; 239/327, 575, 590

[56] References Cited

U.S. PATENT DOCUMENTS

| | | | |
|---|---|---|---|
| 4,057,177 | 11/1977 | Laauwe | 222/481.5 X |
| 4,093,124 | 6/1978 | Morane et al. | 222/189 X |
| 4,102,476 | 7/1978 | Loeffler | 222/212 X |
| 4,474,314 | 10/1984 | Roggenburg, Jr. | 222/494 |
| 4,513,891 | 4/1985 | Hain et al. | 222/494 X |
| 4,519,530 | 5/1985 | Schmidt | 222/494 |
| 4,930,667 | 6/1990 | Holzner, Sr. | 222/189 |
| 5,025,957 | 6/1991 | Ranalletta et al. | 222/213 X |

FOREIGN PATENT DOCUMENTS

| | | | |
|---|---|---|---|
| 0114007 | 7/1984 | European Pat. Off. | 222/420 |
| 0363172 | 4/1990 | European Pat. Off. | 222/189 |
| 793710 | 4/1958 | United Kingdom | 222/420 |
| 2106877 | 4/1983 | United Kingdom . | |

*Primary Examiner*—Andres Kashnikow
*Assistant Examiner*—Anthoula Pomrening
*Attorney, Agent, or Firm*—Howrey & Simon

[57] ABSTRACT

A dispenser for dispensing sterile solution which includes a valve to control the dispensing of the sterile solution from a container. The valve comprises a solution outlet and an air inlet opening having an associated filter membrane to filter the air passing into the container. When dispensing the solution, force applied to the container causes the solution outlet to open and prevents access of the solution to the air inlet opening. When the force is relieved, a partial vacuum is formed in the container which causes the solution outlet to close. Air is then drawn into the container via the air inlet opening and through the filter membrane.

8 Claims, 4 Drawing Sheets

DISPENSER FOR DISPERSING STERILE SOLUTIONS

This invention relates to valve means for use with a dispenser, and, in particular, valve means for use with a dispenser to control the dispensing of a sterile solution from a sterile container whilst maintaining the remaining solution in a sterile condition.

Non aerosol dispensers for dispensing sterile solutions in the form of large droplets, for example, for dispensing saline solution for use with contact lenses, have suffered for a number of years with problems concerning maintenance of the solution within the dispenser in a sterile condition.

A majority of the non aerosol dispensers available are operated by the application of pressure to the dispenser for force the liquid within the dispenser to be dispensed. As will be appreciated when the dispenser has dispensed the correct amount of liquid and the pressure has consequently been relieved, a partial vacuum will result in the dispenser. In order to balance the partial vacuum air is caused to flow into the bottle by means of any available opening. The problems with conventional dispenser designs results from this infusion of air, which can result in:

a) dispensed and now non-sterile solution being drawn back and into the dispenser and b) particles, microbes and germs being carried into the dispenser by the air.

Some conventional designs of dispensers do incorporate filter means which are placed so as to ensure that the air being drawn into the dispenser to replace the solution/air which has been expelled during the dispensing, is filtered and, therefore, sterile. With these types of dispenser design, the dispenser is designed in such a way that upon the dispensing of the solution some solution is forced into the provided filter means. This causes the pores/spaces in the filter means to become loaded with solution, and effectively the filter means is blocked.

Obviously upon relief of the force applied to dispense the solution the air drawn into the dispenser causes some of the pores/spaces to unblock. However, the unblocked pores/spaces are in the minority, and a majority of the pores/spaces unblocked will be the same for each time the dispenser is used. This causes preferential paths for the passage of air through the filter means to be established resulting in areas of relatively high contamination within the filter means. In turn this could, in all probability, later in the life of the dispenser lead to contamination of the sterile solution within the dispenser and all the problems this could cause.

The present invention is concerned with providing a dispenser which overcomes the above mentioned problems.

In accordance with the present invention there is provided a dispenser for dispensing sterile solution including a valve means to control the dispensing of the sterile solution from a sterile container, where the force required to dispense the solution is applied by displacing inwardly the sides of the container, which valve means comprises:

- a solution outlet means;

and - an air inlet opening having associated therewith a microscopic filter membrane to remove particles, microbes and/or germs from the air passing through said filter membrane;

wherein during application of the force to dispense the solution, the solution is caused to flow through the solution outlet means but is prevented from accessing the air inlet opening and associated filter membrane, and when the force is relieved causing a partial vacuum to exist in the dispenser the solution outlet means is immediately closed to form a sealing contact and air is drawn through the air inlet opening and associated filter membrane, so as to maintain the sterile environment within the dispenser, until an equilibrium pressure situation is reached in which the respective pressures across the valve means are such that the sealing contact of the solution outlet means is maintained.

The advantage with this design of dispenser is that the filter membrane is maintained in a dry condition, and thus prevented from becoming wetted by the solution as it is dispensed. Therefore the earlier mentioned problems of preferable paths through the filter membrane is alleviated.

In a preferred embodiment of the present invention chambers are provided which fill up with sterile air, and which are also sealingly isolated from the sterile solution during dispensing of the solution, which chambers are however immediately communicable with the partial vacuum when this is formed.

The advantages with this arrangement of the present invention revolve around the fact that the partial vacuum draws preferably on the sterile air in these chambers rather than the air/any dispensed solution in the vicinity of the outlet means as the outlet means closes under the action of the partial vacuum. Consequently, the problem identified in the above passages relating to the drawing back into the dispenser of already dispensed, therefore non-sterile, solution is further alleviated.

Preferably, the solution outlet means is sized and shaped so that the sterile solution is dispensed in the form of droplets.

Alternatively, the solution outlet means is sized and shaped so that the dispenser can be used as a large volume dispenser.

In a preferred arrangement of the present invention, the air inlet opening may comprise a single opening or a series of openings, which are provided with a groove which is sized so that any solution falling over the groove bridges said groove so enabling an air flow path to be established to the opening or series of openings.

The solution outlet means and the air inlet opening are, preferably, sealed, under the appropriate pressure differential, by means of the same member which is caused to move by the pressure differential to effect the necessary sealing. Preferably, the member to effect the sealing of the solution outlet means and the air inlet opening is formed from a rubber material, most preferably, silicone rubber.

In out particular arrangement of the present invention the member to effect the sealing of the solution outlet means and the air inlet opening is formed from KRATON (A Styrene Butadene Styrene rubber). A suitable alternative material is SANOPRENE.

The invention will now be illustrated, by way of description, of three examples of dispensers made in accordance with the present invention and as shown in the accompanying drawings, in which.

Figure 1:
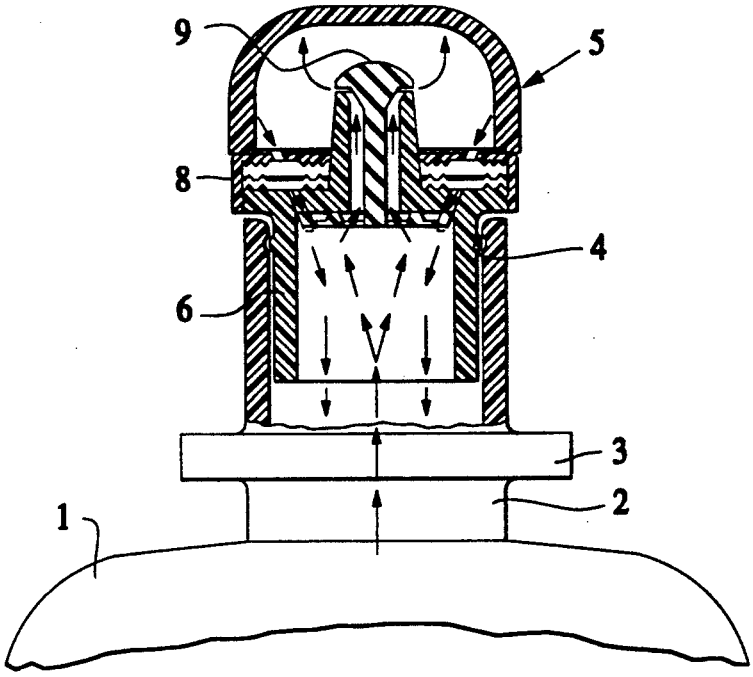
FIG. 1 shows a cross sectional schematic representation of an assembled dispenser made in accordance with the present invention.
Figure 2:
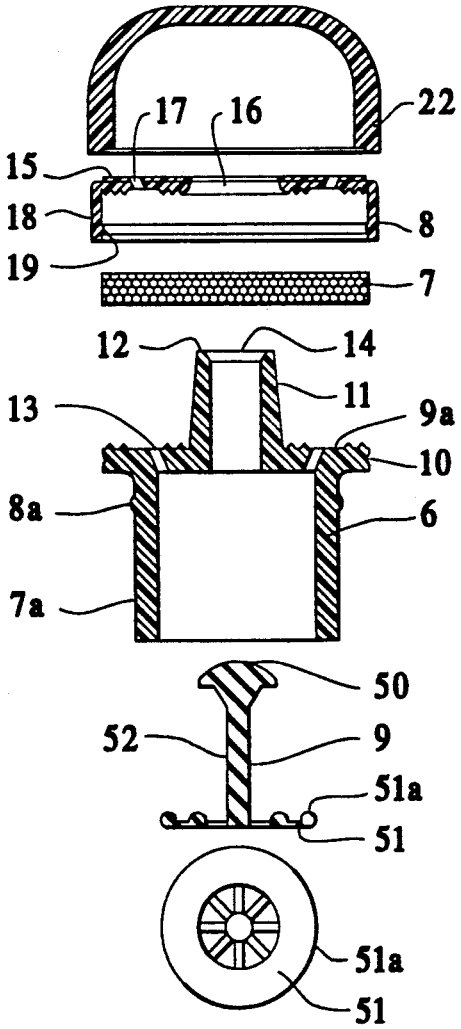
FIG. 2 shows cross sectional schematic representations of the components of the first valve means of the dispenser shown in FIG. 1.
Figure 3:
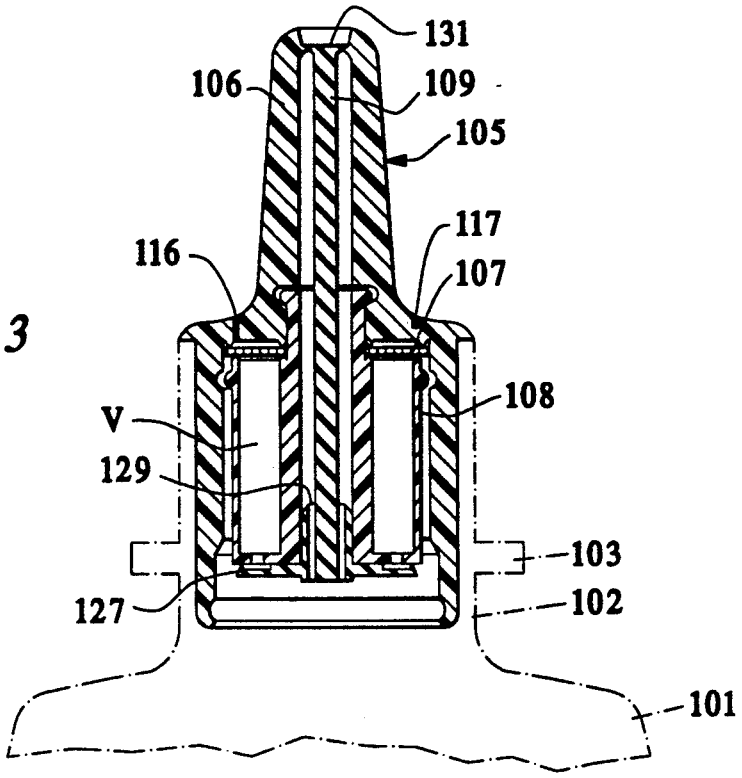
FIG. 3 shows a cross sectional schematic representation of a second dispenser made in accordance with the present invention.
Figure 4A:
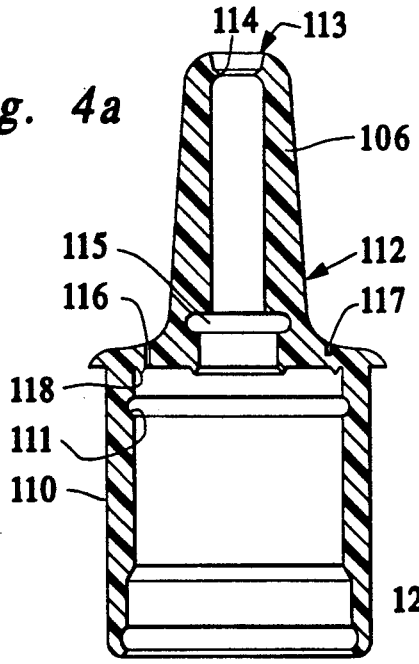
FIGS. 4a–4c show a cross sectional schematic representation of the components of the valve means of the second dispenser shown in FIG. 2.
Figure 4B:
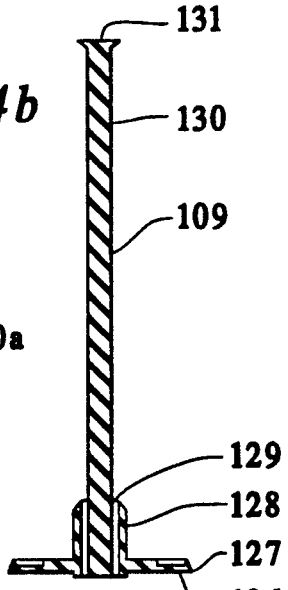
Figure 4D:
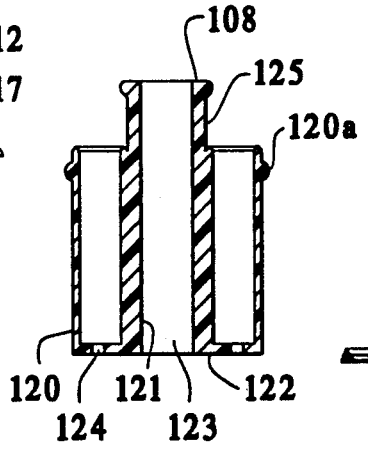
Figure 4C:
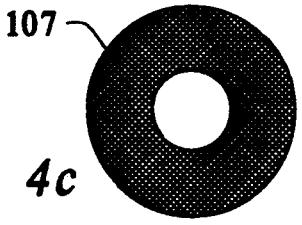
Figure 4E:
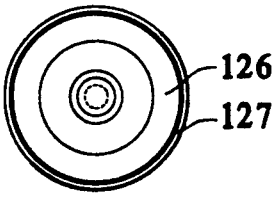

Now referring to FIGS. 1 and 2 of the accompanying drawings there is shown a dispenser for dispensing sterile solution which incorporates a first form of valve means made in accordance with the present invention.

The dispenser comprises a storage means 1 made from a suitable plastics materials which storage means 1 includes a neck portion 2 having an open end, and an externally extending collar 3 and an indent 4 on the internal surface in close proximity to the open end of the neck portion, and a valve means 5.

The valve means 5 is fitted into the open end of the neck portion 2 and comprises:

- a body member 6;
- a filter membrane 7;
- a seal cap 8;

and - a valve member 9.

The body member 6 is substantially hollow in construction and comprises: a main section 7a having a detent 8a which when the body member is located in the neck portion 2 of the dispenser acts to secure the valve means 5 in position; an outwardly protruding collar 9a having detent means 10; an upwardly extending outlet means 11 having an abutment 12 and an opening 14; and, an opening 13 formed in the main section 7a of the body member at a position remote from the opening 14 of the outlet means 11. The filter membrane 7 has a pore size in the region of 0.2 microns, and in an operational condition is located about the upwardly extending outlet means 11 so that it is in contact with the upper surface of the body member and covers the opening 13. The filter membrane 7 has been sized to ensure that any particles, microbes, germs etc contained in air passing therethrough is filtered out.

The seal cap 8 formed from a plastics material, for example low Density Polyethylene, and comprises an upper portion 15 having a centrally located opening 16, a second opening 17 isolated from the opening 16, and, a circumferentially extending side wall 18 around the periphery of the upper portion 15. The side wall 18 is provided with circumferentially extending inwardly facing abutment 19.

In an operational condition the seal cap 8 is located so that the upwardly extending outlet means 11 of the body member extends through the opening 16 and forms a sealing contact therewith, and the abutment 19 forms a sealing location in the detent means 10 of the collar 9a in the body member 6.

The location of the seal cap 8 relative to the body member 6 acts to locate and secure the filter membrane 7 in place. Further, in order to ensure that the filter membrane 7 is securely held in position ribs are provided on both the body member 6 and the seal cap 8 to lock the filter membrane 7 in position.

The valve member 9 comprises a rubber member which is formed from KRATON or SANOPRENE or a suitable silicone and which includes:

- a head portion 50;
- a disc like base portion 51 having a circumferential sealing ring 51a;

and - an elongate stem portion 52, which interconnects the head portion 50 and the disc like base portion 51.

The valve member 9 is located within the body member 6 so that the stem portion 52 extends within the upstanding outlet means 11 with its head portion 50 disposed externally of the dispenser and its disc like base portion 51 disposed within the body member 6.

Further, it should be noted that the head portion 50 and the disc like base portion 51 are dimensioned so that they will not readily pass into the passage of the upstanding outlet means 11 through which the solution passes.

In operational use, the head portion 50 will readily seal against the abutment 12 of said passage in order to prevent the flow of fluid therealong when there is a pressure differential acting inwards with respect to the dispenser, and the disc like base portion 51 readily seals the openings 13 in the base member 6 when there is a pressure differential acting outwards from the dispenser.

The valve means 5 is also provided with a dirt cap 22.

When in use the user applies pressure to the dispenser by squeezing the sides of the storage means 1 causing the pressure within the dispenser to increase. In turn this causes the sealing ring 51a of the disc like base portion 51 to seal the openings 13 in the body member 6 and the head portion 50 of the valve member 9 to be displaced from sealing contact with the abutment 12 of the outlet means 11 so allowing fluid to pass through the outlet means 11. If the dispenser is correctly oriented the fluid passing through the outlet means 11 will be sterile solution from within the storage means 1.

It should be noted that the outlet means 11 and the head portion 50 of the valve member 9 have been shaped to dispense the sterile solution in the form of large droplets.

Once the user has dispensed sufficient sterile solution for the required purpose, the pressure being applied to the dispenser is relived. In turn this causes a partial vacuum to be formed in the storage means 1 of the dispenser, so causing the head portion 50 of the valve member 9 to return to sealing contact with the abutment 12 of the outlet means 11 and the sealing contact between the sealing ring 51a of the disc like portion 51 of the valve member 9 to be broken.

Further, the partial vacuum draws air from the surrounding environment into the dispenser by means of the openings 17 in the seal cap 8 and the openings 13 in the body member 6. The air drawn in passes through the filter membrane 7 in order to remove unwanted particles, microbes, germs etc, and hence sterilise the air, prior to passing through the opening 17 in the seal cap 8 and into the storage means 1.

Once an equilibrium balance has been achieved the air is no longer drawn into the dispenser, and in this condition the head portion 50 of the valve maintains a sealing contact with the abutment 12 of the outlet means 11.

Now referring to FIGS. 3 and 4a–4e of the accompanying drawings, a dispenser is shown with a second form of valve means in accordance with the present invention.

The dispenser comprises a storage means 101 having a neck portion 102 with a circumferentially extending outstanding collar 103 and an open end; and a valve means 105. The valve means is push fitted into the open end of the neck portion 102 of the storage means 101.

The valve means 105 comprises:

- a body member 106;
- a filter membrane 107;
- a plug member 108; and
- a valve member 109.

The body member 106 is an integrally formed member which comprises:

- a main section 110 of generally tubular construction which has an internal circumferential groove 111 adjacent to one end thereof;
- a cap section 112 located at the end of the main section 110 with the circumferential groove 111 and extending beyond the main section 110 so as to define a collar and lip;
- a nozzle 113 formed in the cap section 112 the passage for which allows the sterile solution within the dispenser to be dispensed which passage at the dispensing end has a lip 114 and at the other end a locating means 115;
- a series of openings 116 in the cap section 112 remote from the passage in the nozzle 113 communicating between the external atmosphere and the internal atmosphere of the dispenser and a groove 117 is formed in the external surface of the cap section 112 interconnecting all the openings 116;

and - two circular abutments 118 formed on the bottom of the cap section 112 within the confines of the main section 110.

The groove 117 is sized so that it provides a means by which the openings 116 can operate properly even if a droplet of liquid covers the opening 116. In order to achieve this the groove is sized so that liquid bridges over the top and does not enter the groove, so enabling a route to the opening 116 for the flow of air to be established.

The filter membrane 107 is sized so that it prevents the passage of particles, microbes, germs etc therethrough.

The plug member 108 is of integral construction and comprises:

- an outer tubular member 120 which adjacent to one end thereof has an external circumferential abutment 120*a;*
- an inner tubular member 121 which is located so that it is coaxial with the outer tubular member 120;
- a bottom plate 122 located at the end of the outer tubular member 120 remote from the abutment 120*a*, which bottom plate has a central opening 123 which communicates with the internal space of the inner tubular member 121 and a series of openings 124 circumferentially spaced from one another which communicate with the space defined by the inner tubular member 121 and the outer tubular member 120;
- a number of dividers which divide the space between the inner tubular member 121 and the outer tubular member 120 into a number of distinct volumes, each of which volumes V has an associated opening 124;

and - a locating extending 125 which engages with the locating means 115 of the body member 106 to correctly locate the plug member 108 with respect to the body member 106.

The valve member 109 is formed from silicone rubber (or KRATON or SANOPRENE) and comprises:

- a disc like base member 126 having a sealing ring 127 at the outer periphery thereof; a base support section 128 having a number of through passages 129 formed therein;
- an elongated stem section 130 extending from the base support section 128;

and - a valve forming member 131 formed at the other end to the base support section 128 of the elongate stem section 130.

In an assembled condition the plug member 108 is fitted into the main section of the body member 106 so that the locating extension 125 of the plug member 108 engages in the locating means 115 of the body member 106 and the abutment 120*a* of the plug member 108 engages in the groove 111 of the body member. This correctly locates the body member 106 and the plug member 108 with respect to one another so that the passage through the nozzle 113 through which the sterile solution passes for dispensing is in alignment, and therefore communication, with the inner tubular 121 member of the plug member 108.

The filter membrane 107 is located around the locating extension 125 of the plug member, and is consequently disposed in the space defined by the plug member 108 and the cap section of the body member 106.

The valve member 109 is disposed in the passage of the nozzle 113 and the space within the inner tubular member 121 so that:

- the disc like base member 126 is in contact with the bottom plate 122 of the plug member 108 with the sealing ring 127 of the disc like base member spaced circumferentially outward from the series of openings 124 in said bottom plate 122;
- the base support section 128 is disposed in the space within the inner tubular member 121 of the plug member in sealing contact with inner tubular member 120 to enable sterile solution to enter the space within inner tubular member 120 by means of the through passages 129 in the base support section 128 only;

and - the valve forming member 131 is disposed outwardly with respect to the plug member 108 against the lip 114 in the passage of the nozzle 113.

Further, the elongate stem section 130 is disposed along the space within the inner tubular member 121 and the passage in the nozzle 113, and is held under tension to ensure that sealing contact is maintained between the lip 114 and the valve forming member 131 under normal conditions.

The whole assembly described above is the valve means 104 and is disposed in the neck portion 102 of the storage means 101.

In use, the user applies pressure to the storage means 101 of the dispenser, so causing the pressure within the dispenser to rise above that of the surrounding atmosphere. This causes the sealing ring 127 of the disc like member to come into sealing contact with the bottom plate 122 of the plug member 108 preventing the passage of the sterile solution in the dispenser through the openings 124 in said bottom plate 122, and the seal between the valve forming member 131 and the lip 114 in the passage of the nozzles 113 is broken. If the dispenser has been correctly orientated sterile solution will now flow along the through passages 129 in the base support section 128 of the valve member 109 into the space within the inner tubular member 121 and the passage in the nozzle 113 and around the valve forming member 131 of the valve member 109 to be dispensed as large droplets.

Once the user has dispensed sufficient sterile solution he releases the pressure on the dispenser so causing a partial vacuum to form within the dispenser.

The partial vacuum causes the sealing ring 127 of the disc like base member 126 to break sealing contact with the bottom plate 122 and the sterile air trapped between the filter membrane 107 and said disc like base member to enter the storage means. Further, simultaneously the valve forming member 131 re-establishes sealing contact with the lip 114 in the passage within the nozzle 113.

The sterile air released into the storage means 101 prevents any of the dispensed, now non-sterile, solution in the vicinity of the valve forming member 131 from being drawn back into the dispenser.

Further, air is drawn into the storage means under action of the partial vacuum through the opening 116, the filter membrane 107 and the openings 124 in the bottom plate 122 of the plug means 108, until an equilibrium condition is reached. In the equilibrium condition, the valve forming member 131 of the valve member 108 maintains sealing contact with lip 114 in the passage in the nozzle 113.

It should be noted the two examples detailed above have referred to the dispensing of sterile solution in droplet form. This is not intended in any way to limit the scope of the present invention which has been stated earlier as clearly including large volume dispensers.

Figure 5:
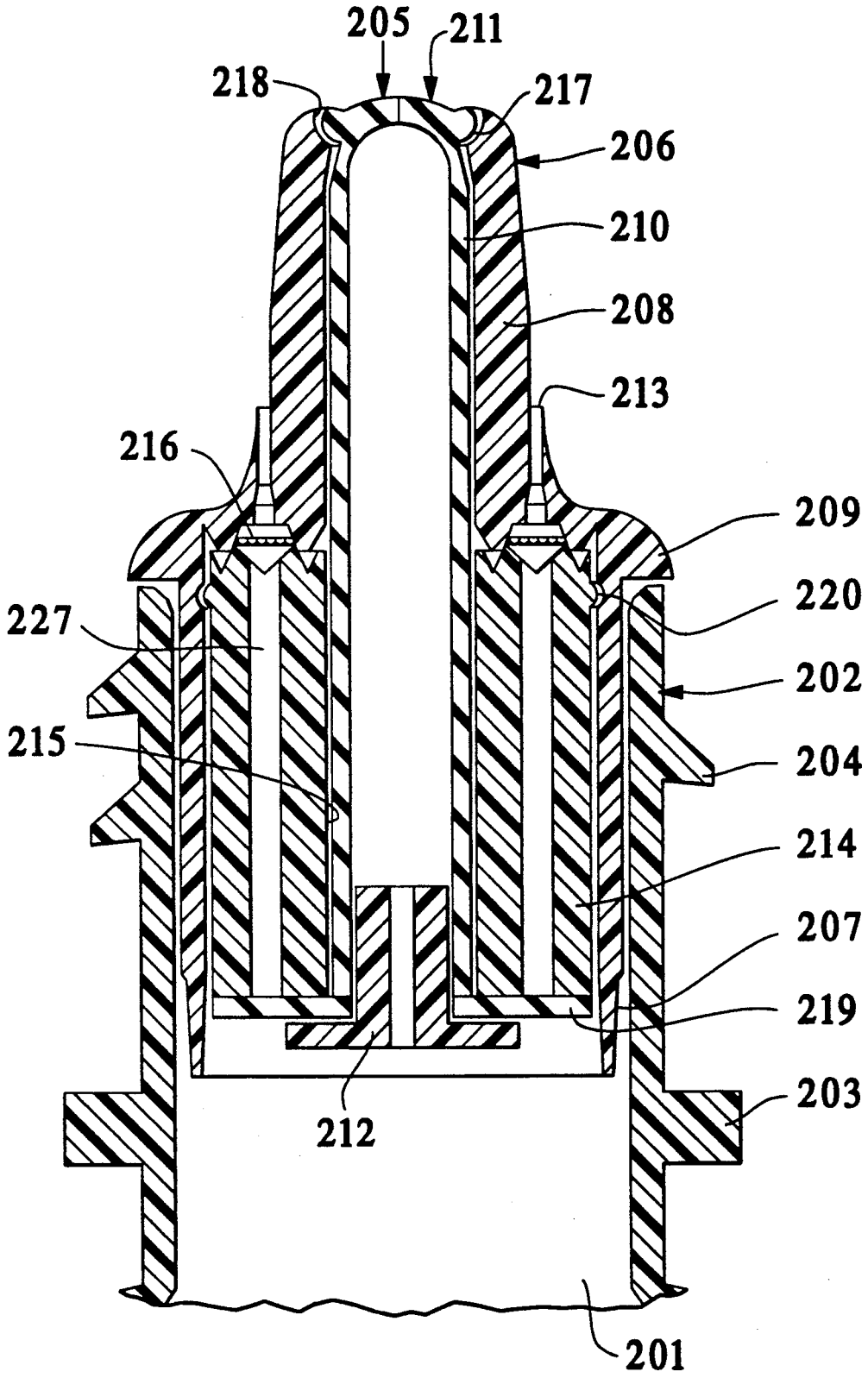
FIG. 5 shows a cross sectional side view of a third dispenser made in accordance with the present invention.

Now referring to FIG. 5 of the accompanying drawings there is shown a third example of a dispenser made in accordance with the present invention. In this particular example it is intended for use as a large volume dispenser.

The dispenser comprises a storage means 201 having a necked portion 202 with an abutment shoulder 203 and a helically extending abutment 204 onto which a dust cap (not shown) may be disposed so that it abuts against the abutment shoulder 203.

A valve means 205 is disposed into the neck portion of the storage means 201. The valve means 205 comprises

- an outer body member 206 made from a hard polymeric material and having a main section 207, an outlet section 208 and a circumferentially extending shoulder 209;
- a rubber valve member 210 including an outlet means 211 for the dispensing of the sterile solution from the storage means 201;
- a flow restrictor means 212;
- an air inlet opening 213 formed through the outer body member 206;
- an inner body member 214 having a constant diameter throughbore 215 through which the rubber valve member 210 can be disposed and surrounding the throughbore 215 are a series of chambers 227 open at one end to the air inlet opening and at the other end to the storage means; and
- a filter membrane 216 disposed in a spaced defined by the air inlet opening 213 and the inner body member 214.

The rubber valve member 210 which is formed from SANOPRENE or KRATON or a suitable silicone rubber comprises:

- a tip section having an opening formed therein to allow for the dispensing of sterile solution from the storage means 201, and a circumferentially extending collar 217 which locates in a groove 218 formed in the outlet section 208 of the outer body member 206;
- a hollow central section having the tip section formed at one end thereof; and
- a disc like member 219 formed at the end remote from the tip section, which disc like member 219 has a central orifice communicating with the space defined in the hollow central section.

In an assembled condition the rubber valve member 210 is inverted so that it extends along the constant diameter throughbore 215 of the inner body member 214 and the flow restrictor means 212 is inserted into the central orifice in the disc like member 219, and thereby into the constant diameter throughbore 215 of the inner body member 214.

Further when assembled into the outer body member 206, the rubber valve member 210 is disposed so the circumferentially extending collar 217 engages in the groove 218 and the inner body member 214 is encased within the outer body member 206 so that an abutment 220 provided on the inner body member 214 engages in a grooves in the main section 207 of the outer body member 206.

When used the storage means 201 is squeezed, causing the pressure within the dispenser to increase. If the dispenser has been correctly orientated the increase in pressure within the storage means 201 will cause the sterile solution within the dispenser to be dispensed via the outlet means 211 of the rubber valve member 210. Further, the disc like member 219 will be forced into sealing contact with the inner body member 214 and so prevent the flow of sterile solution into the chambers 227 and onto the filter membrane 216.

Therefore, during the dispensing of sterile solution from the dispenser the filter membrane is maintained in dry condition and so ensuring efficient operation thereof.

Now when the pressure within the storage means is relieved a partial vacuum forms in the storage means, this causes the outlet means 211 to close so preventing the ingress of non-sterile air to the dispenser, and the disc like member 219 to break its sealing contact with the inner body member 214. In order to allow the situation to equilibriate, the partial vacuum draws air into the dispenser via the air inlet opening 213, which air is caused to pass through the filter membrane 216 and thus be sterilised.

Figure 6:
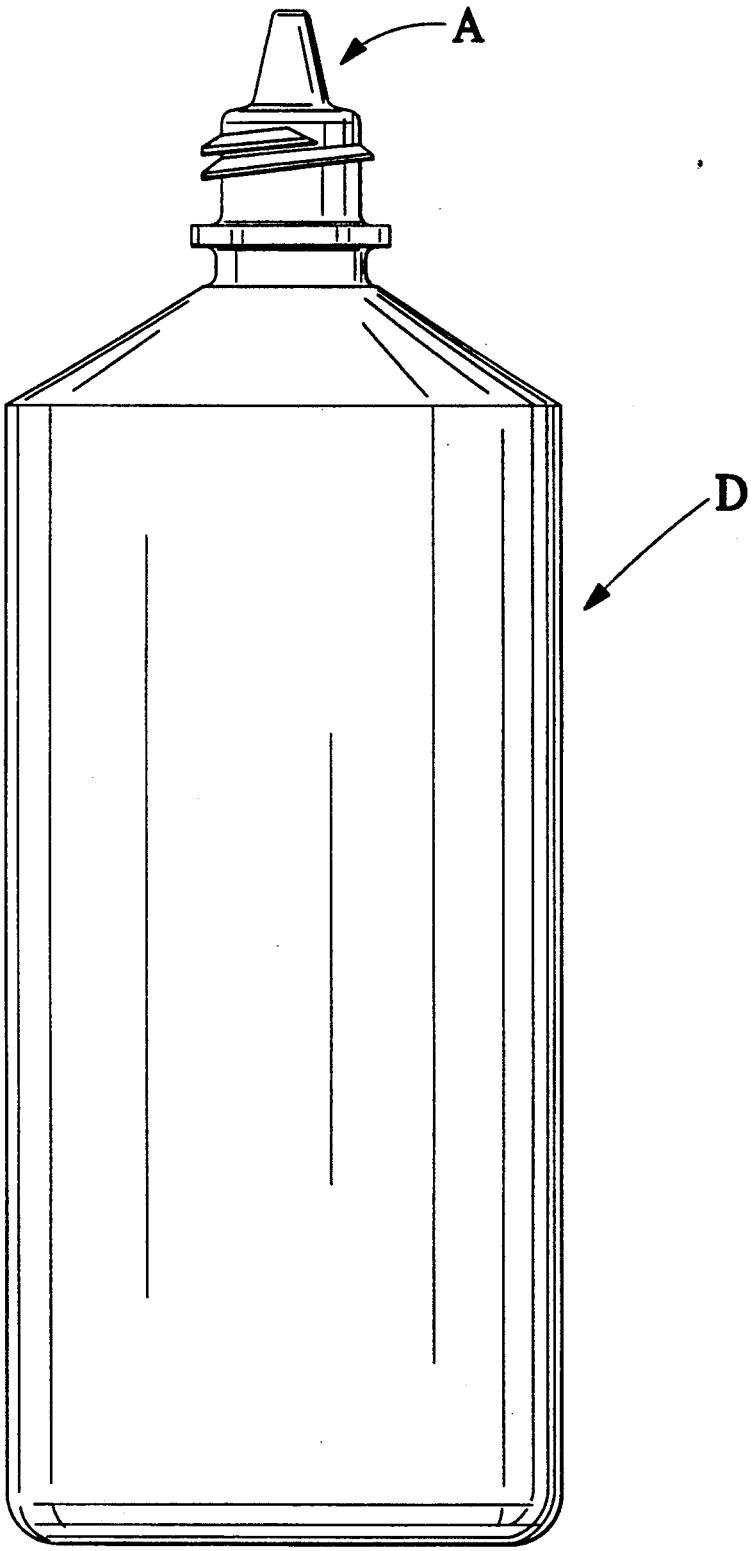
FIG. 6 shows a container incorporating one of the valve means shows in any one of FIGS. 1 to 5.

Now referring to FIG. 6 of the accompanying drawings, there is shown a dispenser D having a valve means A as described in any one of the accompanying examples fitted in the neck thereof.

What we claim is:

1. A dispenser for dispensing sterile solution including a valve means to control the dispensing of the sterile solution from a sterile container, where the force required to dispense the solution is applied by displacing inwardly the sides of the container, which valve means comprises:

- an outer body member of generally hollow construction with a main section, a solution outlet means and air inlet means;
- an inner body member which is located in the outer body member and includes solution outlet means and air inlet means;

- a filter membrane associated with the air inlet means of the inner and outer body members and which is sized so as to prevent the passage of particles, microbes and germs; and
- a rubber valve member;

wherein during application of the force to dispense the solution, the solution is caused to flow through the solution outlet means of the inner and outer body members but is prevented from accessing the air inlet means of the inner and outer body members and associated filter membrane by the rubber valve member, and when the force is relieved causing a partial vacuum to exist in the dispenser, the solution outlet means of the inner and outer body members are immediately closed by the rubber valve member as air is drawn through the air inlet means of the inner and outer body members and associated filter membrane, so as to maintain the sterile environment within the dispenser, until an equilibrium pressure situation is reached in which the respective pressures across the valve means are such that sealing contact of the rubber valve member with at least one of the solution outlet means is maintained.

2. A dispenser as claimed in claim 1, wherein the valve means further includes chambers which fill up with sterile air, and which are sealingly isolated from sterile solution during dispensing of the solution, which chambers are however immediately communicable with the partial vacuum upon formation of the partial vacuum.

3. A dispenser as claimed in claim 1, wherein the solution outlet means of the outer body member is sized and shaped so that the sterile solution is dispensed in the form of droplets.

4. A dispenser as claimed in claim 1, wherein the solution outlet means of the outer body member is sized and shaped so that the dispenser can be used as a large volume dispenser.

5. A dispenser as claimed in claim 1, wherein the air inlet means of the outer body member comprises openings, which are provided with a groove which is sized so that any solution falling over the groove bridges said groove so enabling an air flow path to be established to the openings.

6. A dispenser as claimed in claim 1, wherein the rubber valve member which effects the sealing of the solution outlet means of the inner and outer body members and the air inlet means of the inner and outer body members is formed from silicone rubber.

7. A dispenser as claimed in claim 1, wherein the rubber valve member which effects the sealing of the solution outlet means of the inner and outer body members and air inlet means of the inner and outer body members is formed from KRATON.

8. A dispenser as claimed in claim 1, wherein the rubber valve member which effects the sealing of the solution outlet means of the inner and outer body members and air inlet means of the inner and outer body members is formed from SANOPRENE.

* * * * *